US009156265B2

(12) United States Patent
Asada

(10) Patent No.: US 9,156,265 B2
(45) Date of Patent: Oct. 13, 2015

(54) MANUFACTURING METHOD OF LIQUID EJECTING HEAD

(71) Applicant: SEIKO EPSON CORPORATION, Tokyo (JP)

(72) Inventor: Koji Asada, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/204,583

(22) Filed: Mar. 11, 2014

(65) Prior Publication Data

US 2014/0284305 A1 Sep. 25, 2014

(30) Foreign Application Priority Data

Mar. 21, 2013 (JP) ..... 2013-058559

(51) Int. Cl.
*B41J 2/16* (2006.01)
*B41J 2/14* (2006.01)

(52) U.S. Cl.
CPC ..... *B41J 2/1607* (2013.01); *B41J 2/161* (2013.01); *B41J 2/1623* (2013.01); *B41J 2/1629* (2013.01); *B41J 2/1645* (2013.01); *B41J 2/1646* (2013.01); *B41J 2002/14241* (2013.01); *B41J 2002/14419* (2013.01)

(58) Field of Classification Search
CPC ..... B41J 2/1607; B41J 2/161; B41J 2/1623
USPC ..... 216/27
See application file for complete search history.

(56) References Cited

U.S. PATENT DOCUMENTS

2011/0069121 A1* 3/2011 Park et al. ..... 347/47

FOREIGN PATENT DOCUMENTS

JP 4798348 8/2011

* cited by examiner

*Primary Examiner* — Nadine Norton
*Assistant Examiner* — Mahmoud Dahimene
(74) *Attorney, Agent, or Firm* — Workman Nydegger

(57) ABSTRACT

A piezoelectric actuator which is provided on the flow path formation substrate, and a protection substrate which is bonded to the flow path formation substrate on the piezoelectric actuator side, the method including: bonding the flow path formation substrate on which the piezoelectric actuator is formed, and the protection substrate to form a bonded body; bonding a sealing member to the protection substrate of the bonded body on the surface side opposite the flow path formation substrate, and disposing a protection material containing a nitro compound in a space between the sealing member and the protection substrate.

4 Claims, 6 Drawing Sheets

MANUFACTURING METHOD OF LIQUID EJECTING HEAD

BACKGROUND

1. Technical Field

The present invention relates to a manufacturing method of a liquid ejecting head which ejects liquid from nozzle openings, particularly a manufacturing method of an ink jet type recording head which discharges ink as liquid.

2. Related Art

There is a known ink jet type recording head which is the liquid ejecting head including a flow path formation substrate in which a pressure generation chamber communicating with nozzle openings is formed, a piezoelectric actuator which is provided on one surface side of the flow path formation substrate, and a protection substrate which is bonded to the flow path formation substrate on the piezoelectric actuator side.

In addition, such an ink jet type recording head is manufactured by forming the piezoelectric actuator on the flow path formation substrate which is formed of a silicon single-crystal substrate, then bonding the protection substrate to the upper portion thereof, and then, in a state where a surface of the protection substrate which is on the opposite surface side to the flow path formation substrate is covered and protected by a sealing sheet, performing wet etching of the flow path formation substrate with an etching solution formed of an alkaline aqueous solution such as KOH to form the pressure generation chamber and the like (for example, see Japanese Patent No. 4798348).

However, if the wet etching of the flow path formation substrate which is formed of a silicon single-crystal substrate is performed with the etching solution formed of an alkaline aqueous solution such as potassium hydroxide (KOH), hydrogen gas is generated and damages a piezoelectric layer so that a piezoelectric property of the piezoelectric layer is decreased.

Such a problem does not only occur in the manufacturing method of the ink jet type recording head, but also occurs in a manufacturing method of a liquid ejecting head which ejects liquid other than ink.

SUMMARY

An advantage of some aspects of the invention is to provide a manufacturing method of a liquid ejecting head in which damage to a piezoelectric element due to hydrogen is suppressed.

According to an aspect of the invention, there is provided a manufacturing method of a liquid ejecting head including a flow path formation substrate on which a pressure generation chamber communicating with nozzle openings for ejecting liquid is formed, a piezoelectric actuator which is provided on the flow path formation substrate, and a protection substrate which is bonded to the flow path formation substrate on the piezoelectric actuator side, the method including: bonding the flow path formation substrate on which the piezoelectric actuator is formed, and the protection substrate to form a bonded body; bonding a sealing member to the protection substrate of the bonded body on the surface side opposite the flow path formation substrate, and disposing a protection material containing a nitro compound in a space between the sealing member and the protection substrate; and performing wet etching of the flow path formation substrate of the bonded body to which the sealing member is bonded, to form the pressure generation chamber.

In this case, since hydrogen gas generated when performing the wet etching is adsorbed by the protection material containing the nitro compound, it is possible to suppress damage to the piezoelectric actuator due to the hydrogen gas.

Herein, it is preferable that, in the disposing of the protection material, the protection material be disposed at a temperature lower than a melting point thereof, and in performing the wet etching of the flow path formation substrate, the wet etching be performed at a temperature higher than the melting point of the protection material. According to this, since the protection material is solid when being disposed, it is possible to prevent a decrease of adhesiveness from occurring due to attachment of the protection material to a bonded surface of the sealing member or the like. In addition, since the protection material is liquid when performing the wet etching, hydrogen adsorption is efficiently performed.

In addition, it is preferable that the nitro compound contain at least one kind selected as a solvent from a group consisting of polyethylene glycol, polypropylene glycol, and polyglycerol. According to this, it is possible to easily set the protection film in a solid form at a normal temperature (room temperature) and in a liquid form at a temperature when performing the wet etching.

In addition, it is preferable that the flow path formation substrate be formed of a silicon substrate, and in performing wet etching of the flow path formation substrate, the wet etching be performed using potassium hydroxide. According to this, it is possible to form the pressure generation chamber or the like on the flow path formation substrate with high precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiment of the invention will be described in detail.

Embodiment 1

Figure 1:
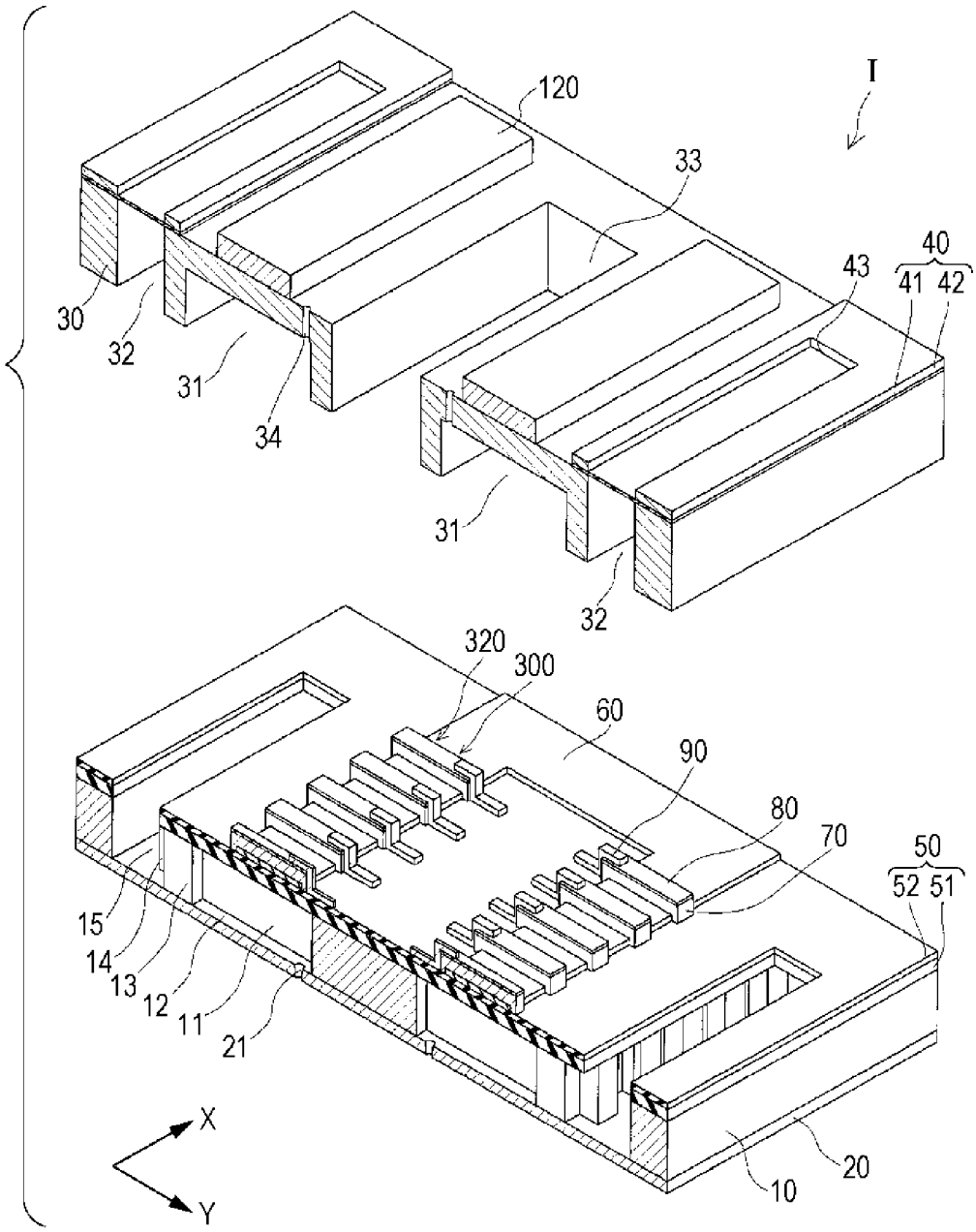
FIG. 1 is an exploded perspective view of a recording head according to Embodiment 1 of the invention.
Figure 2A:
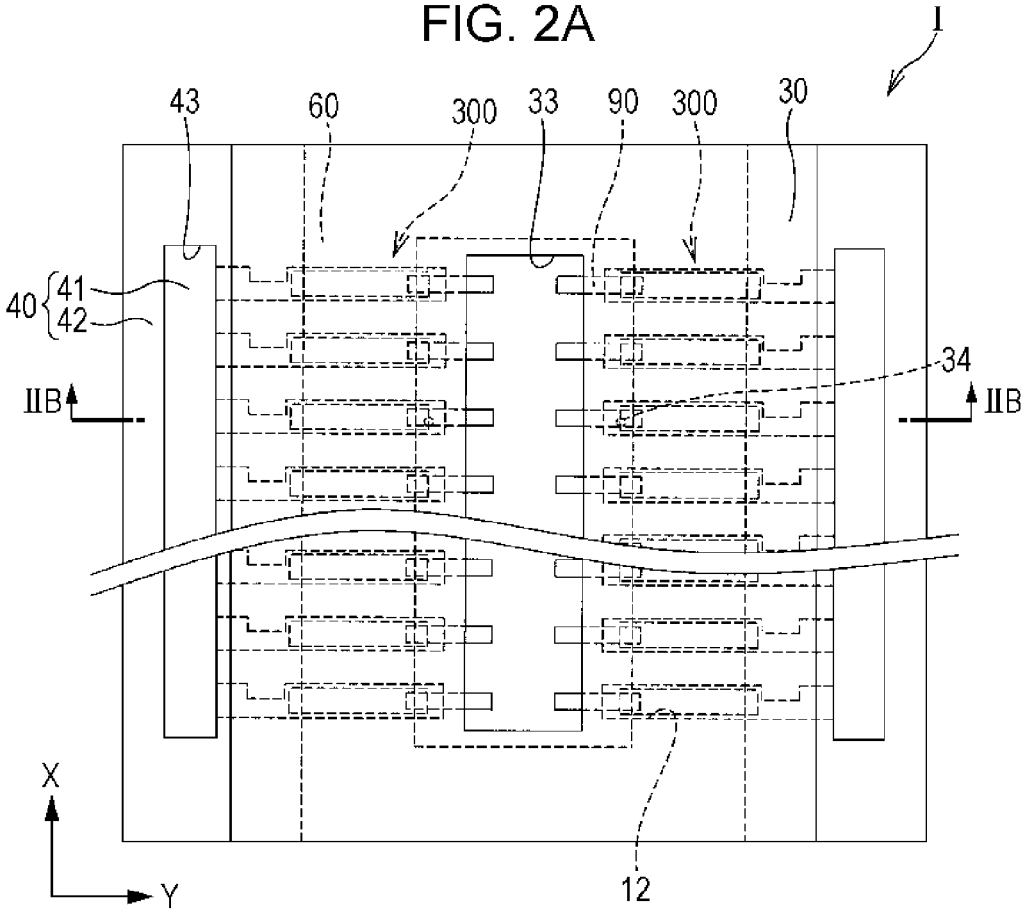
FIGS. 2A and 2B are a plan view and a cross-sectional view of a recording head according to Embodiment 1 of the invention.
Figure 2B:
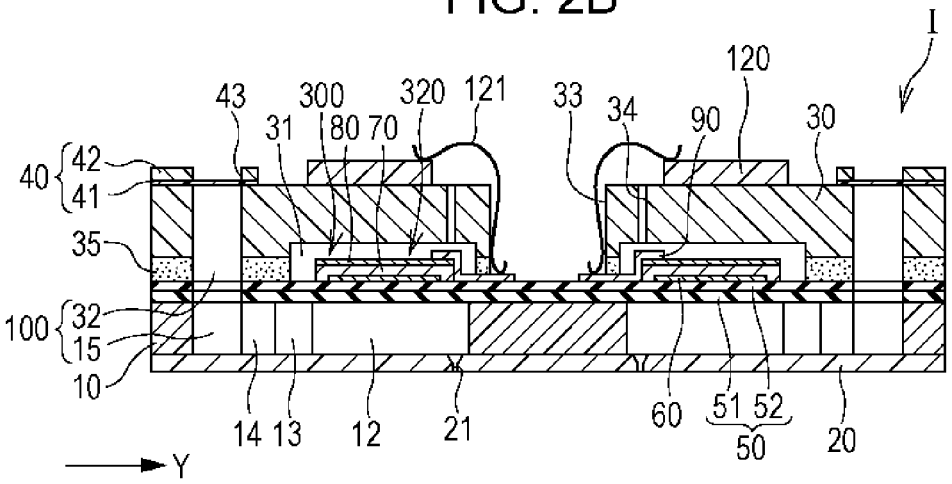

FIG. 1 is an exploded perspective view showing a schematic configuration of an ink jet type recording head which is an example of the liquid ejecting head according to Embodiment 1 of the invention and FIGS. 2A and 2B are a plan view of FIG. 1 and a cross-sectional view taken along line IIB-IIB, respectively.

As shown in the drawings, in the embodiment, a flow path formation substrate 10 included in an ink jet type recording head I which is an example of the liquid ejecting head of the embodiment is, for example, formed of a substrate including a silicon material, for example, a single-crystal silicon substrate or a polycrystal silicon substrate. In the flow path formation substrate 10, pressure generation chambers 12 which are partitioned by a plurality of partition walls 11 are provided in a line along a direction in which a plurality of nozzle openings 21 ejecting ink are provided in a line. Hereinafter, this direction is referred to as a direction in which the pressure generation chambers 12 are provided in a line or a first direction X. In the embodiment, two columns of the pressure generation chamber 12 which are provided in a line along the first direction X, are provided along a second direction Y which intersects with the first direction X.

Ink supply paths 13 which apply flow path resistivity by setting an opening area of the pressure generation chamber 12 to be small, and communication paths 14 which have an opening area substantially the same as that of the pressure generation chamber 12 are divided by the plurality of partition walls 11 on one end portion side of the flow path formation substrate 10 in a longitudinal direction of the pressure generation chamber 12, that is, on one end portion side in the second direction Y intersecting with the first direction X. A communication portion 15 configuring a part of a manifold 100 which is a common ink chamber (liquid chamber) of each pressure generation chamber 12 is formed on the outside of the communication path 14 (side opposite to the pressure generation chamber 12 in the second direction Y). That is, a liquid flow path formed of the pressure generation chamber 12, the ink supply path 13, the communication path 14, and the communication portion 15 is provided on the flow path formation substrate 10.

A nozzle plate 20 through which the nozzle openings 21 communicating with each pressure generation chamber 12 penetrate is bonded to one surface side of the flow path formation substrate 10, that is, a surface on which the liquid flow path of the pressure generation chamber 12 or the like is opened, with an adhesive or a thermal welding film. In the embodiment, since the two columns in which the pressure generation chambers 12 are provided in a line in the first direction X, are provided in the second direction Y, two nozzle columns in which the nozzle openings 21 are provided in a line in the first direction X, are provided in the second direction Y, in one ink jet type recording head I.

A vibrating plate 50 is formed on the other surface side of the flow path formation substrate 10. In the embodiment, the vibrating plate 50 is configured to include an elastic film 51 formed of silicon oxide which is provided on the flow path formation substrate 10 side and an insulating film 52 formed of zirconium oxide which is provided on the elastic film 51. The liquid flow path such as the pressure generation chamber 12 is formed by performing anisotropic etching (wet etching) of the flow path formation substrate 10 from one surface thereof (a surface side to which a nozzle plate 20 is bonded), and the other surface of the liquid flow path such as the pressure generation chamber 12 or the like is partitioned by the elastic film 51.

Herein, in addition to it being necessary that the vibrating plate 50 (in a case of laminated film, on electrode formation side) is an insulator and can withstand a temperature when forming the piezoelectric layer 70 (generally 500° C. or higher), in a case of using the anisotropic etching (wet etching) by KOH (potassium hydroxide) when forming a flow path such as the pressure generation chamber 12 using a silicon wafer for the flow path formation substrate 10, it is necessary that the vibrating plate (in a laminated case, silicon wafer side) functions as an etching stopping layer. In addition, in a case of using silicon dioxide for a part of the vibrating plate 50, if lead or bismuth contained in the piezoelectric layer 70 diffuses to silicon dioxide, silicon dioxide changes in properties and an electrode of an upper layer or the piezoelectric layer 70 is peeled off. Accordingly, a layer for preventing the diffusion thereof to silicon dioxide is also necessary.

Since each material of the vibrating plate 50 on which silicon dioxide and zirconium oxide are laminated, withstands the temperature when forming the piezoelectric layer 70, silicon dioxide functions as an insulating layer and an etching stopping layer, and zirconium oxide functions as an insulating layer and a diffusion prevention layer, the vibrating plate 50 having this configuration is most preferable. In the embodiment, the vibrating plate 50 is formed with the elastic film 51 and the insulating film 52, but either one of the elastic film 51 and the insulating film 52 may be provided as the vibrating plate 50. In addition, a part of the flow path formation substrate 10 can be used as the vibrating plate by performing a thinning process.

In addition, a first electrode 60, a piezoelectric layer 70, and a second electrode 80 are formed by laminating by a process which will be described later to configure a piezoelectric actuator 300 on the insulating film 52 of the vibrating plate 50. Herein, the piezoelectric actuator 300 is a portion including the first electrode 60, the piezoelectric layer 70, and the second electrode 80. In general, any one electrode of the piezoelectric actuator 300 is set to a common electrode, and the other electrode and the piezoelectric layer 70 are patterned for each pressure generation chamber 12. Herein, a portion which is configured from any one patterned electrode and the piezoelectric layer 70 and on which piezoelectric strain is generated by applying voltage to both electrodes is called a piezoelectric active portion 320. In the embodiment, the first electrode 60 is set to a common electrode of the piezoelectric actuator 300 and the second electrode 80 is set to an individual electrode of the piezoelectric actuator 300. However, there is no problem in the reverse case according to circumstances of a driving circuit or wiring. In the example described above, since the first electrode 60 is continuously provided over the plurality of pressure generation chambers 12, the first electrode 60 functions as a part of the vibrating plate, but is not limited thereto, of course. For example, only the first electrode 60 may operate as the vibrating plate without providing the elastic film 51 and the insulating film 52. In addition, the piezoelectric actuator 300 itself may substantially function as the vibrating plate. However, in a case of providing the first electrode 60 directly on the flow path formation substrate 10, it is preferable to protect the first electrode 60 with an insulating protection film so that the first electrode 60 and the ink are not electrically connected to each other. That is, in the embodiment, the configuration in which the first electrode 60 is provided on the substrate (flow path formation substrate 10) through the vibrating plate 50 is exemplified, but it is not particularly limited thereto, and the first electrode 60 may be directly provided on the substrate without providing the vibrating plate 50. That is to say, the first electrode 60 may operate as the vibrating plate. That is, a phrase "on the substrate" includes a state directly on the substrate and a state with the other interposed member (upper portion).

In addition, the piezoelectric layer 70 is formed of a piezoelectric material such as oxide having a polarized structure which is formed on the first electrode 60, and for example, can be formed of perovskite-type oxide shown as a general formula $ABO_3$. A can include lead, and B can include at least one of zirconium and titanium. B can further include niobium, for example. In detail, as the piezoelectric layer 70, for example, lead zirconate titanate ($Pb(Zr,Ti)O_3$: PZT), or lead zirconate titanate niobate ($Pb(Zr,Ti,Nb)O_3$: PZTNS) containing silicon can be used.

The piezoelectric layer 70 may be set to composite oxide having a perovskite structure containing a lead-free piezoelectric material which does not contain lead such as bismuth ferrate or bismuth manganate ferrate, and barium titanate or bismuth potassium titanate.

In addition, a lead electrode 90 formed of, for example, gold (Au) which is extracted from the vicinity of the end portion which is on the side opposite the ink supply path 13 and is provided to extend to the upper portion of the vibrating plate 50, is connected to each second electrode 80 which is an individual electrode of the piezoelectric actuator 300.

A protection substrate 30 including a manifold portion 32 configuring at least a part of the manifold 100 is bonded to the upper portion of the flow path formation substrate 10 on which the piezoelectric actuator 300 is formed, that is, on the upper portions of the vibrating plate 50, the first electrode 60, and the lead electrode 90, with an adhesive 35. In the embodiment, the manifold portion 32 penetrates the protection substrate 30 in the thickness direction and is formed in the width direction of the pressure generation chamber 12, and communicates with the communication portion 15 of the flow path formation substrate 10 as described above to configure the manifold 100 which is the common ink chamber of each pressure generation chamber 12. In addition, the communication portion 15 of the flow path formation substrate 10 may be divided into plural portions for each pressure generation chamber 12, and only the manifold portion 32 may be set as a manifold. Further, only the pressure generation chamber 12 may be provided on the flow path formation substrate 10, and the ink supply path 13 communicating the manifold 100 and each pressure generation chamber 12 may be provided on the elastic film 51 and the insulating film 52 interposed between the flow path formation substrate 10 and the protection substrate 30.

On the protection substrate 30, a piezoelectric actuator holding portion 31 having a space for not inhibiting the driving of the piezoelectric actuator 300 is provided in a region facing the piezoelectric actuator 300. The piezoelectric actuator holding portion 31 may have a space as long as it does not inhibit the driving of the piezoelectric actuator 300, and the space may be sealed or not sealed. In the embodiment, an independent piezoelectric actuator holding portion 31 is formed for each column of the piezoelectric actuators 300 which are provided in a line in the first direction X. In addition, in the embodiment, an atmosphere release path 34 which communicates the piezoelectric actuator holding portion 31 and the outside is provided on the protection substrate 30. Accordingly, by increasing pressure in the piezoelectric actuator holding portion 31 when the piezoelectric actuator 300 is deformed, it is possible to suppress inhibition of the deformation of the piezoelectric actuator 300.

In addition, a penetration hole 33 which penetrates through the protection substrate 30 in the thickness direction is provided on the protection substrate 30. The vicinity of the end portion of the lead electrode 90 which is extracted from each piezoelectric actuator 300 is provided so as to be exposed in the penetration hole 33.

A driving circuit 120 which functions as a signal processing unit is fixed onto the protection substrate 30. As the driving circuit 120, a circuit board or a semiconductor integrated circuit (IC) can be used, for example. The driving circuit 120 and the lead electrode 90 are electrically connected to each other through a connection wire 121 formed of a conductive wire such as a bonding wire which is inserted through the penetration hole 33.

As the protection substrate 30, a material having substantially the same coefficient of thermal expansion as the flow path formation substrate 10, for example, glass, a ceramic material, or the like is preferably used, and in the embodiment, a silicon single-crystal substrate which is made of the same material as that of the flow path formation substrate 10 is used for formation thereof.

A compliance substrate 40 formed of a sealing film 41 and a fixed plate 42 is bonded onto the protection substrate 30. Herein, the sealing film 41 is formed of a flexible material having low rigidity, for example, polyphenylene sulfide (PPS) film, and one surface of the manifold portion 32 is sealed by the sealing film 41. In addition, the fixed plate 42 is formed of a hard material such as metal, for example, stainless steel (SUS). Since the region of the fixed plate 42 facing the manifold 100 is set to an opening portion 43 which is completely removed in the thickness direction, one surface of the manifold 100 is sealed only with the sealing film 41 having flexibility.

In the ink jet type recording head I of the embodiment, the ink is introduced from an ink introduction port which is connected to an external ink supply unit (not shown), and the inside from the manifold 100 to the nozzle opening 21 is filled with the ink. After that, the piezoelectric actuator 300 corresponding to the pressure generation chamber 12 is driven according to a recording signal from the driving circuit 120, and accordingly the vibrating plate 50 is bent and deformed. Therefore, the pressure in each pressure generation chamber 12 is increased, and ink droplets are discharged from the nozzle openings 21.

Herein, a manufacturing method of the ink jet type recording head of the embodiment will be described with reference to FIGS. 3A to 6C. FIGS. 3A to 6C are cross-sectional views showing the manufacturing method of the ink jet type recording head according to the Embodiment 1 of the invention.

Figure 3A:
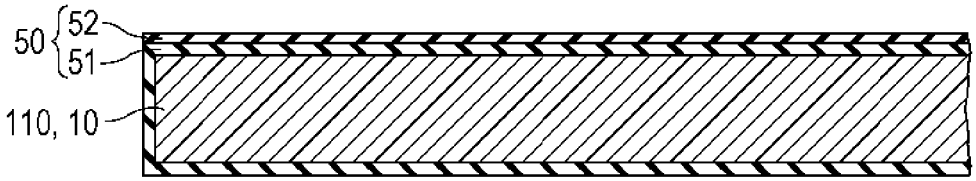
FIGS. 3A to 3D are cross-sectional views showing a manufacturing method of a recording head according to Embodiment 1 of the invention.

First, as shown in FIG. 3A, the vibrating plate 50 is formed on a surface of a flow path formation substrate wafer 110 which is a silicon wafer. In the embodiment, the vibrating plate 50 which is formed of laminated layers of silicon dioxide (elastic film 51) formed by thermal oxidation of the flow path formation substrate wafer 110 and zirconium oxide (insulating film 52) formed by thermal oxidation after forming a film by a sputtering method, is formed.

In addition to it being necessary that the vibrating plate 50 (in a case of laminated film, on electrode formation side) is an insulator and can withstand the temperature when forming the piezoelectric layer 70 (generally 500° C. or higher), in a case of using the anisotropic etching by KOH (potassium hydroxide) when forming a flow path such as the pressure generation chamber 12 using a silicon wafer for the flow path formation substrate 10, it is necessary that the vibrating plate (in a laminated case, silicon wafer side) functions as an etching stopping layer. In addition, in a case of using silicon dioxide for a part of the vibrating plate 50, if lead or bismuth contained in the piezoelectric layer 70 diffuses to silicon dioxide, silicon dioxide changes in properties and an electrode of an upper layer or the piezoelectric layer 70 is peeled off. Accordingly, a layer for preventing the diffusion thereof to silicon dioxide is necessary.

Since each material of the vibrating plate 50 on which silicon dioxide and zirconium oxide are laminated, withstands the temperature when forming the piezoelectric layer 70, silicon dioxide functions as an insulating layer and an etching stopping layer, and zirconium oxide functions as an insulating layer and a diffusion prevention layer, the vibrating plate 50 having this configuration is most preferable. In the embodiment, the vibrating plate 50 is formed with the elastic film 51 and the insulating film 52, but either one of the elastic film 51 and the insulating film 52 may be provided as the vibrating plate 50.

Figure 3B:
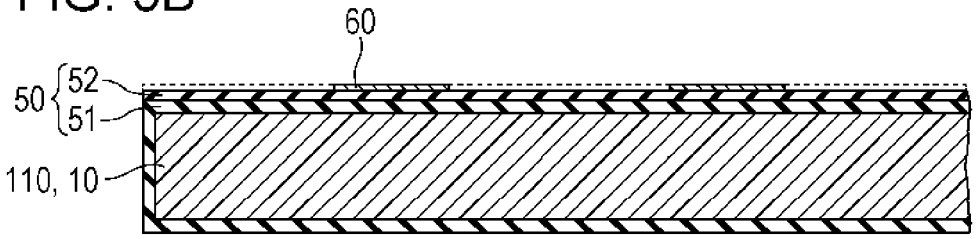

Next, as shown in FIG. 3B, the first electrode 60 is formed on the entire surface of the vibrating plate 50 and is patterned in a predetermined shape. The material of the first electrode 60 is not particularly limited, but is necessarily a material which does not lose conductivity due to oxidation at the time of performing thermal treatment (generally 500° C. or higher) when forming the piezoelectric layer 70 or diffusion of the material contained in the piezoelectric layer 70. Accordingly, metal such as platinum, iridium, or the like which does not lose conductivity even at a high temperature, or conductive oxide such as iridium oxide, lanthanum nickel oxide, or the like, and a layered material of the materials thereof are preferably used as the material of the first electrode 60. In addition, the first electrode 60 can be formed, for example, with a vapor phase film by a sputtering method, a physical vapor deposition (PVD) method, a laser ablation method or the like, or a liquid phase film by a spin coating method. An adhesion layer for securing adhesiveness between the conductive material described above and the vibrating plate 50 may be used. In the embodiment, although not particularly shown in the drawings, titanium is used as the adhesion layer. As the adhesion layer, zirconium, titanium or titanium oxide can be used. A method of forming the adhesion layer is the same as that of the electrode material. In addition, a control layer for controlling crystal growth of the piezoelectric layer 70 may be formed on the electrode surface (film forming side of the piezoelectric layer 70). In the embodiment, titanium is used for control of crystals of the piezoelectric layer 70 (PZT). Since the titanium is introduced into the piezoelectric layer 70 when forming the piezoelectric layer 70, titanium does not exist as a film after forming the piezoelectric layer 70. As the crystal control layer, conductive oxide having a perovskite-type crystal structure such as lanthanum nickel oxide may be used. A method of forming the crystal control layer is the same as that of the electrode material. The insulating crystal control layer desirably does not exist between the piezoelectric layer 70 and the first electrode 60 after forming the piezoelectric layer 70. This is because the capacitors of the crystal control layer and the piezoelectric layer 70 are connected to each other in series, and therefore an electric field to be applied to the piezoelectric layer 70 is decreased. As the embodiment, by using titanium as an orientation control layer, the orientation control layer is introduced into the piezoelectric layer 70 and therefore does not exist as a film, while it is supposed to be subjected to the thermal treatment to become an oxide (insulator).

Figure 3C:
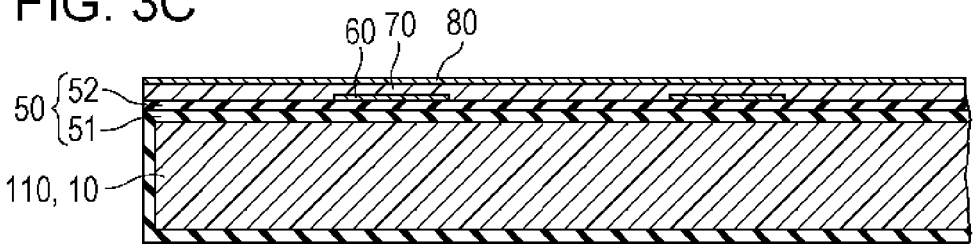

Next, as shown in FIG. 3C, the piezoelectric layer 70 and the second electrode 80 are sequentially formed and laminated on the first electrode 60. Herein, in the embodiment, the piezoelectric layer 70 is formed by using a so-called sol-gel method for obtaining the piezoelectric layer 70 formed of metal oxide by coating and drying a so-called sol which is obtained by dissolving and dispersing a metal complex in a solvent to be converted into a gel and burning the gel at a high temperature. The manufacturing method of the piezoelectric layer 70 is not limited to the sol-gel method, and for example, a metal-organic decomposition (MOD) method or the physical vapor deposition (PVD) such as the sputtering method or the laser ablation may be used. That is, the piezoelectric layer 70 may be formed by either the liquid phase method or the vapor phase method. In addition, metal having high conductivity, for example, iridium (Ir) or the like can be used for the second electrode 80.

Figure 3D:
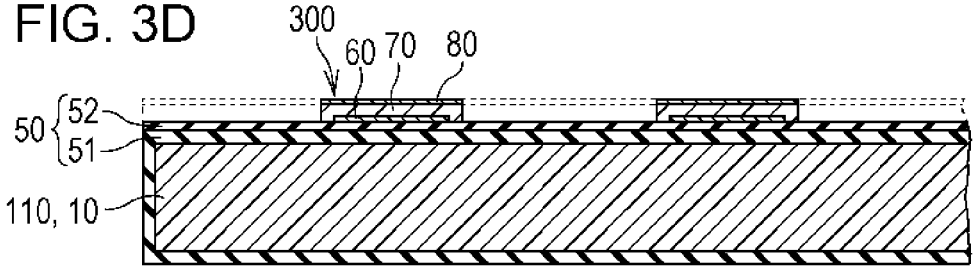

Next, as shown in FIG. 3D, by patterning the piezoelectric layer 70 and the second electrode 80 at the same time, the piezoelectric actuator 300 is formed. For example, dry etching such as reactive ion etching or ion milling is used for the patterning of the piezoelectric layer 70 and the second electrode 80.

Figure 4A:
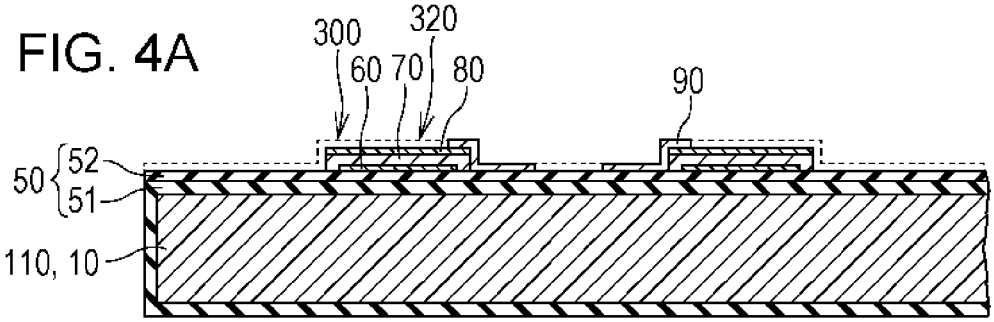
FIGS. 4A to 4C are sectional views showing a manufacturing method of a recording head according to Embodiment 1 of the invention.

Next, as shown in FIG. 4A, the lead electrode 90 formed of gold (Au) is formed and is patterned in a predetermined shape.

Figure 4B:
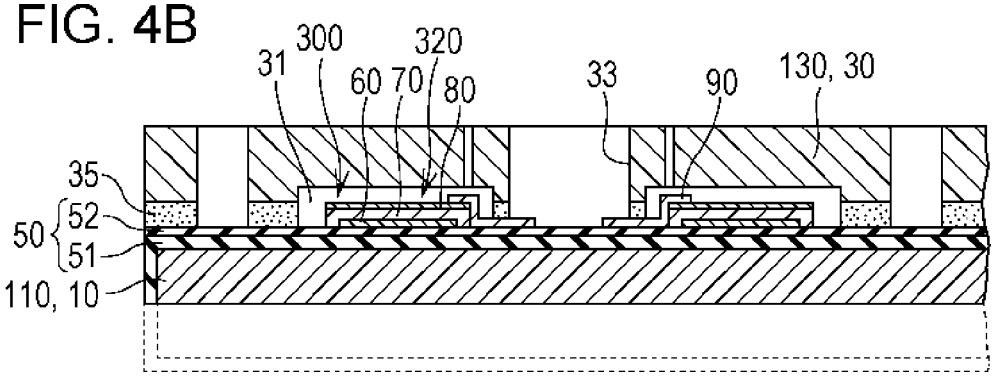

Next, as shown in FIG. 4B, after bonding a protection substrate wafer 130 which is a silicon wafer and is the plurality of protection substrates 30 to the piezoelectric actuator 300 side of the flow path formation substrate wafer 110 through the adhesive 35 to form a bonded body, the flow path formation substrate wafer 110 is set to be thinned to a predetermined thickness.

Figure 4C:
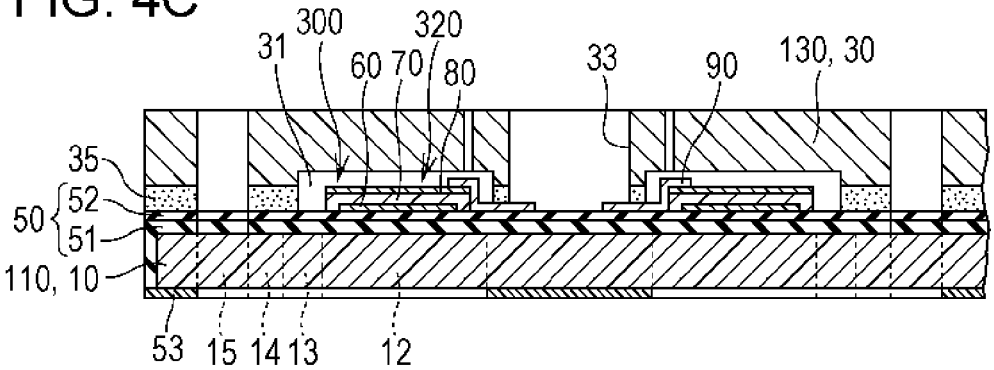

Next, as shown in FIG. 4C, a mask film 53 is newly formed on the flow path formation substrate wafer 110 and is patterned in a predetermined shape.

Figure 5A:
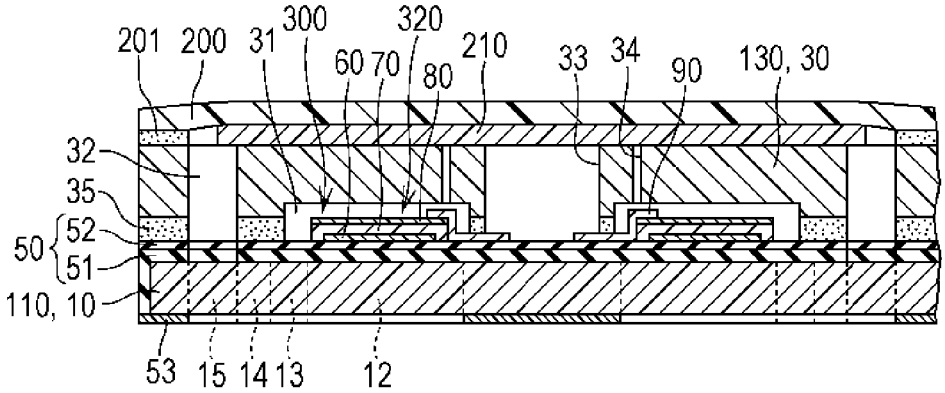
FIGS. 5A and 5B are sectional views showing a manufacturing method of a recording head according to Embodiment 1 of the invention.

Next, as shown in FIG. 5A, a sealing member 200 is bonded to the surface of the protection substrate wafer 130 on the side opposite the surface to which the flow path formation substrate wafer 110 is bonded, through an adhesive 201, and a protection material 210 containing a nitro compound is disposed between the sealing member 200 and the protection substrate wafer 130.

Herein, the sealing member 200 has a sheet shape and covers the surface of the protection substrate wafer 130, and accordingly the sealing member 200 seals the manifold portion 32 and the penetration hole 33 which is formed on the protection substrate wafer 130.

At this time, the sealing member 200 is adhered to an periphery portion of the surface of the protection substrate wafer 130 through the adhesive 201 and is not adhered to a region which is separated to be the protection substrate 30 in a subsequent step.

The sealing member 200 is formed with a material having durability for an alkaline aqueous solution which is used when performing the wet etching of the flow path formation substrate wafer 110. As the material of such a sealing member 200, polyparaphenylene terephthalamide (PPTA) is used, for example. Although not particularly shown in the drawings, the sealing member 200 may include a protection sheet formed with a protection material, in a region which comes into contact with the protection substrate wafer 130. Examples of the protection material include polytetrafluoroethylene (PTFE), polyethylene terephthalate (PET), polyphenylene sulfide (PPS), and the like. Particularly, a material which does not negatively affect the surface of the protection substrate wafer 130, that is, a polymer material which does not interfere with the surface of the protection substrate wafer 130 is preferably used. As such a material, a fluorine resin or the like can be used, and in the embodiment, polytetrafluoroethylene (PTFE) is used.

In addition, the protection material 210 contains the nitro compound. If liquid is used as the protection material 210, when bonding the sealing member 200 to the protection substrate wafer 130, the liquid applies to the protection substrate wafer 130 or the sealing member 200, but the applied liquid may be attached to the adhered surface due to a capillary phenomenon, adhesiveness between the protection substrate wafer 130 and the sealing member 200 may decrease, and accordingly, an etching solution may enter therebetween. Thus, the protection material 210 is preferably solid when being disposed between the protection substrate wafer 130 and the sealing member 200.

In addition, the nitro compound contained in the protection material 210 is a hydrogen adsorbent which adsorbs hydrogen generated when performing the wet etching of the flow path formation substrate wafer 110. Accordingly, when performing the wet etching of the flow path formation substrate wafer 110, the protection material is preferably liquid to efficiently perform the adsorption of hydrogen. Therefore, the protection material 210 is preferably solid at a normal temperature and liquid at a temperature (approximately 80° C.) obtained by heating when performing the wet etching. That is, the protection material 210 is formed of a solid at a normal temperature, and in a step of performing the wet etching of the flow path formation substrate wafer 110, the wet etching is preferably performed at a temperature (approximately 80° C.) which is higher than a melting point of the protection material 210. Accordingly, when performing the wet etching of the flow path formation substrate wafer 110, the protection material 210 is converted to a liquid and the inner portion of the manifold portion 32 and the penetration hole 33 can be filled with the nitro compound. As a solvent of the protection material 210 satisfying such conditions, polyethylene glycol, polypropylene glycol, polyglycerol, or the like is used, for example. That is, the protection material 210 includes at least one kind of solvent selected from a group consisting of polyethylene glycol, polypropylene glycol, and polyglycerol.

In the protection material 210, the solvent of polyethylene glycol is heated to be converted to a liquid and the nitro compound is dissolved in this solvent. The obtained nitro compound solution is applied thereto and by returning the temperature to a normal temperature, the nitro compound solution can be formed in a sheet shape (solid). The protection material 210 including the nitro compound formed in a sheet shape can be easily disposed between the sealing member 200 and the protection substrate wafer 130, and since the protection material 210 is solid, it is possible to suppress the attachment of the protection material 210 to the bonded surface of the sealing member 200 and the protection substrate wafer 130 due to the capillary phenomenon in order to suppress the decrease of adhesiveness.

Figure 5B:
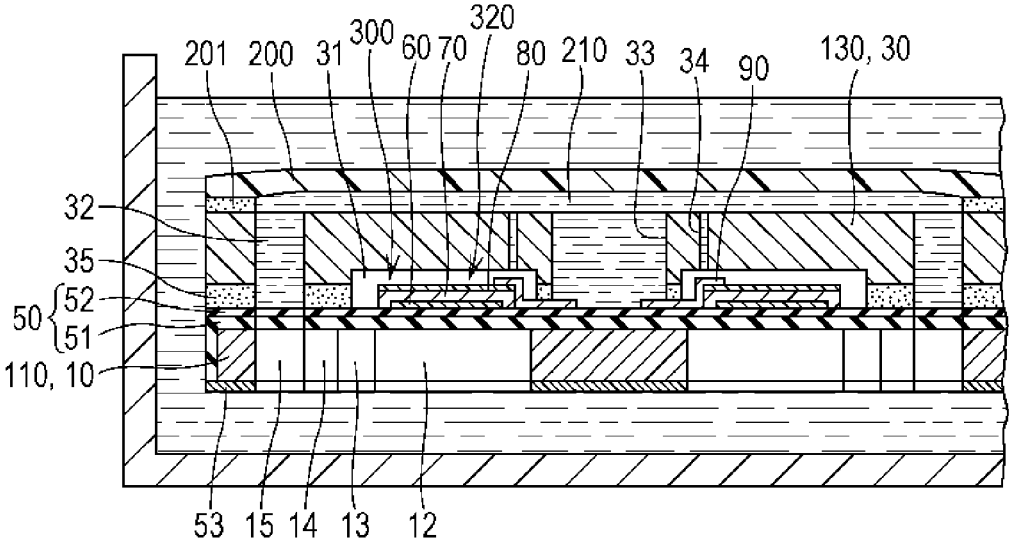

As shown in FIG. 5B, by performing anisotropic etching (wet etching) of the flow path formation substrate wafer 110 using the alkaline aqueous solution through the mask film 53, the pressure generation chamber 12, the ink supply path 13, the communication path 14, and the communication portion 15 corresponding to the piezoelectric actuator 300 are formed. In the embodiment, by immersing the bonded body of the protection substrate wafer 130 to which the sealing member 200 is bonded and the flow path formation substrate wafer 110 in KOH which is heated to approximately 80° C., the wet etching is performed.

Herein, as the alkaline aqueous solution used as the etching solution, potassium hydroxide (KOH), tetramethylammonium hydroxide (TMAH), sodium hydroxide (NaOH) or the like can be used, for example.

If the flow path formation substrate 10 including the silicon material (flow path formation substrate wafer 110) is etched with the alkaline aqueous solution described above, silicon included in the flow path formation substrate 10 and a component included in the alkaline aqueous solution react with each other to generate hydrogen gas. Hereinafter, a reaction between the alkaline aqueous solution described above and the silicon is shown.

$$Si+2OH^{-}+4H_2$$

$$\rightarrow Si(OH)_2^{2+}+4e^{-}+4H_2O$$

$$\rightarrow Si(OH)_2^{2+}+2H_2+4OH^{-}$$

$$\rightarrow Si(OH)_2^{2-}+2H_{2\uparrow}+2H_2O$$

As described above, the hydrogen gas generated when performing the wet etching of the flow path formation substrate wafer 110 using the alkaline aqueous solution has a small molecular weight, and accordingly enters the manifold portion 32 and the penetration hole 33 through boundaries of the adhesives 35 and 201. The hydrogen gas which has entered the manifold portion 32 or the penetration hole 33 enters the piezoelectric actuator holding portion 31 by passing through the boundaries of the atmosphere release path 34 or the adhesive 35, the entered hydrogen gas damages the piezoelectric layer 70, and a piezoelectric property of the piezoelectric layer is degraded.

In the embodiment, by providing the protection material 210 including the nitro compound, between the protection substrate wafer 130 and the sealing member 200, the protection material 210 adsorbs the hydrogen which has entered the inside thereof, and it is possible to suppress the hydrogen gas which has entered the piezoelectric actuator holding portion 31. That is, the protection material 210 is preferably provided in the piezoelectric actuator holding portion 31 which is a space in which the piezoelectric actuator 300 is provided, or a space around this space, that is, in the manifold portion 32 and the penetration hole 33. In the embodiment, the protection material 210 is provided between the protection substrate wafer 130 and the sealing member 200, and since the protection material 210 becomes liquid by heating when performing the wet etching of the flow path formation substrate wafer 110 and is filled in the piezoelectric actuator holding portion 31 or in the manifold portion 32 and the penetration hole 33, it is possible to efficiently adsorb hydrogen and to decrease damage to the piezoelectric layer 70 due to hydrogen.

Figure 6A:
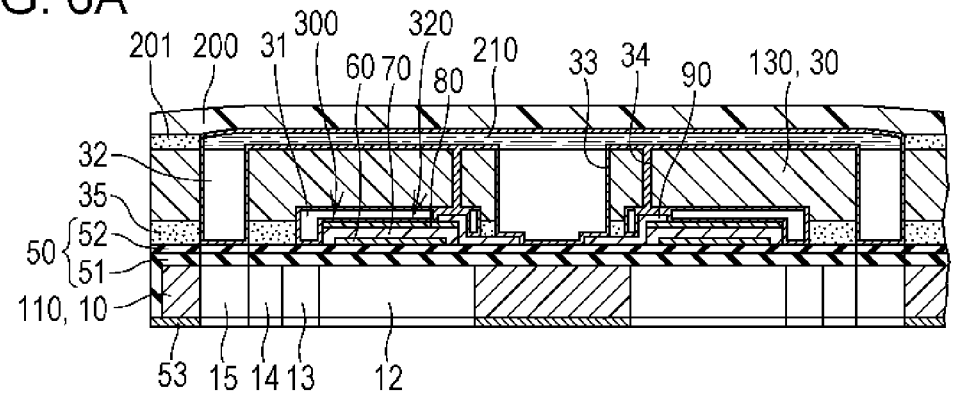
FIGS. 6A to 6C are sectional views showing a manufacturing method of a recording head according to Embodiment 1 of the invention.

Next, as shown in FIG. 6A, the bonded body to which the sealing member 200 is bonded is extracted from the etching solution. Accordingly, the temperature of the bonded body returns to room temperature, and the protection material 210 which fills the manifold portion 32, the piezoelectric actuator holding portion 31, and the penetration hole 33 as liquid is attached to wall surfaces of the manifold portion 32, the piezoelectric actuator holding portion 31, and the penetration hole 33 in a solidified state.

Figure 6B:
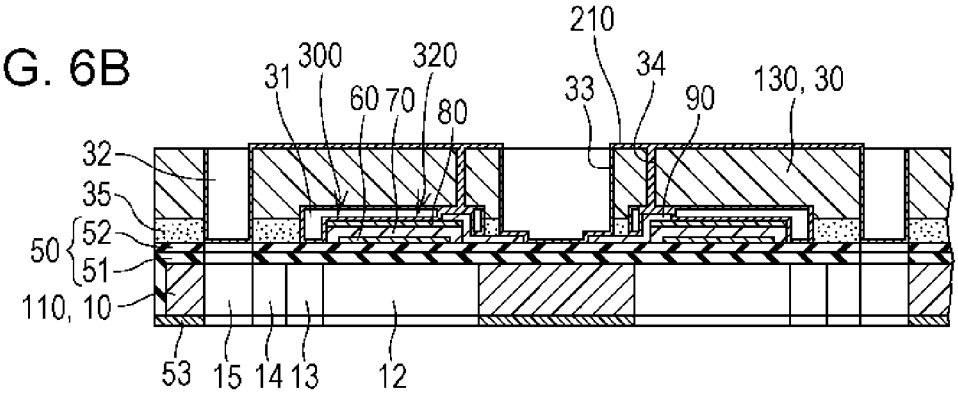

Next, as shown in FIG. 6B, the sealing member 200 is peeled off. For example, in a case where the sealing member 200 is adhered to a region of the protection substrate wafer 130 which is not the protection substrates 30 through the adhesive 201, by cutting and removing an extra portion of the protection substrate wafer 130, the sealing member 200 can be peeled off. That is, the step of peeling off the sealing member 200, and the step of removing an unnecessary portion on an outer periphery portion of the flow path formation substrate wafer 110 and the protection substrate wafer 130 by cutting, for example, by dicing or the like, can be performed at the same time.

Figure 6C:
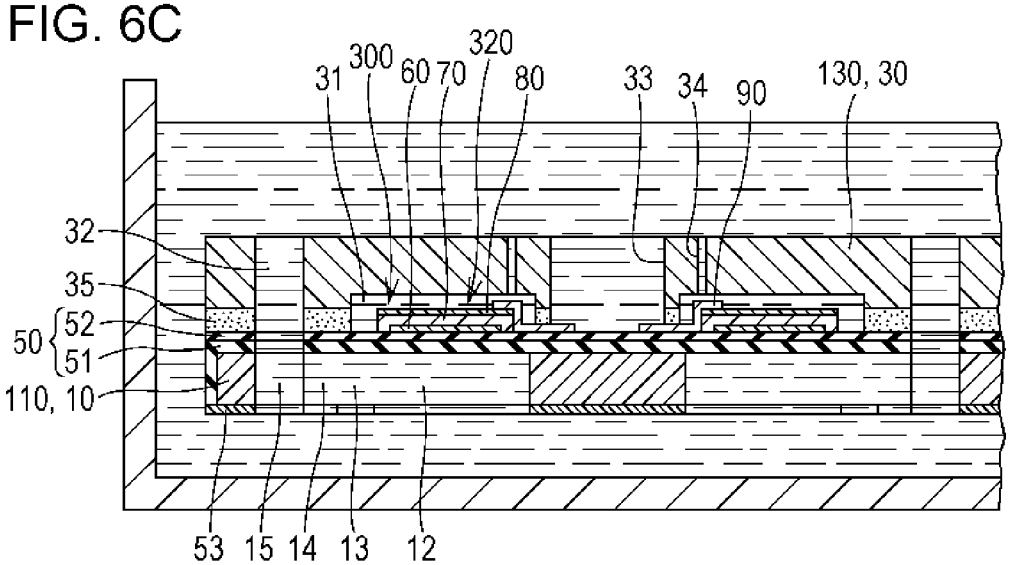

Next, as shown in FIG. 6C, the bonded body of the flow path formation substrate wafer 110 and the protection substrate wafer 130 is cleaned. In the embodiment, cleaning is performed by immersing the bonded body in water. Since a solvent such as polyethylene glycol contained in the protection material 210 is water-soluble, by performing water cleaning, the protection material 210 which is solidified on the wall surfaces of the manifold portion 32, the piezoelectric actuator holding portion 31, and the penetration hole 33 is removed.

After that, the nozzle plate 20 through which the plurality of nozzle openings 21 are penetrated is bonded to the surface of the flow path formation substrate wafer 110 on the side opposite the protection substrate wafer 130, the compliance substrate 40 is bonded to the protection substrate wafer 130, and the flow path formation substrate wafer 110 and the like are divided into chip-sized flow path formation substrates 10 as shown in FIG. 1, to obtain the ink jet type recording head of the embodiment.

As described above, in the embodiment, by performing the wet etching of the flow path formation substrate 10 (flow path formation substrate wafer 110), the hydrogen gas generated when forming the pressure generation chamber 12 or the like is adsorbed by the protection material 210 including the nitro compound, and accordingly, it is possible to suppress the damage to the piezoelectric layer 70 due to hydrogen and to suppress the decrease of the piezoelectric property. Particularly, as the protection material 210, by using a solvent which is solid at room temperature and is liquid at the temperature when performing the wet etching, it is possible to efficiently adsorb the hydrogen gas generated when performing the wet etching by the protection material 210 in a liquid form. In addition, by using the protection material 210 in a solid form, when disposing the protection material 210 between the sealing member 200 and the protection substrate 30 (protection substrate wafer 130), it is possible to suppress attachment thereof to the adhered surface or the like and to suppress the decrease of the adhesiveness.

Other Embodiment

Hereinabove, one embodiment of the invention has been described. However the basic configuration of the invention is not limited thereto.

For example, in Embodiment 1 described above, the solvent which is solid at room temperature and is liquid at the temperature when performing the wet etching is used as the protection material 210, but it is not particularly limited thereto, and the protection material 210 which is liquid at room temperature may be provided. In addition, the protection material 210 may be solid or may be in a powder form at room temperature.

In addition, in Embodiment 1 described above, the protection material 210 is removed by water cleaning, but it is not particularly limited thereto, and the protection material 210 may remain as it is, for example. Accordingly, since hydrogen contained in the atmosphere is adsorbed by the protection material 210, it is possible to further suppress the damage to the piezoelectric layer 70 due to hydrogen during use.

Further, in Embodiment 1, the configuration of including the manifold portion 32 and the penetration hole 33 in the protection substrate 30 is exemplified, but it is not particularly limited thereto, and the manifold portion 32 or the penetration hole 33 may not be provided on the protection substrate 30. It is only necessary to provide the protection material 210 in the piezoelectric actuator holding portion 31 of the protection substrate 30 or in the space in the vicinity thereof.

The invention is intended for a wide variety of general liquid ejecting heads, and can also be applied to manufacturing methods of a recording head such as various ink jet type recording heads used in an image recording apparatus such as a printer, a coloring material ejecting head used in manufacturing a color filter such as a liquid crystal display, an electrode material ejecting head used in electrode forming such as an organic EL display or a field emission display (FED), a bioorganic material ejecting head used in bio chip manufacturing, and the like.

The entire disclosure of Japanese Patent Application No. 2013-058559, filed Mar. 21, 2013 is expressly incorporated by reference herein.

What is claimed is:

1. A manufacturing method of a liquid ejecting head including a flow path formation substrate in which a pressure generation chamber communicating with a nozzle opening for ejecting liquid is formed, a piezoelectric actuator which is provided on the flow path formation substrate and associated with the pressure generation chamber, and a protection substrate which is bonded to the flow path formation substrate on the piezoelectric actuator side of the flow path formation substrate opposite the nozzle opening side, the method comprising:

bonding the flow path formation substrate on which the piezoelectric actuator is formed with the protection substrate to form a bonded body;

disposing a protection material containing a nitro compound on a surface side of the protection substrate that is opposite the flow path formation substrate;

bonding a sealing member to the protection substrate of the bonded body on a surface side opposite the flow path formation substrate such that the protection material is disposed in a space between the sealing member and the protection substrate; and performing wet etching of the flow path formation substrate of the bonded body to which the sealing member is bonded to form the pressure generation chamber in the flow path formation substrate.

2. The manufacturing method of a liquid ejecting head according to claim 1, wherein disposing the protection material includes disposing the protection material a temperature lower than a melting point thereof, and wherein performing includes performing wet etching at a temperature higher than a melting point of the protection material.

3. The manufacturing method of a liquid ejecting head according to claim 1, wherein the nitro compound contains at least one kind selected as a solvent from a group consisting of polyethylene glycol, polypropylene glycol, and polyglycerol.

4. The manufacturing method of a liquid ejecting head according to claim 1, wherein the flow path formation substrate is formed of a silicon substrate, and wherein performing wet etching includes performing wet etching using potassium hydroxide.

* * * * *